US005894708A

United States Patent [19]

Newby et al.

[11] Patent Number: 5,894,708

[45] Date of Patent: Apr. 13, 1999

[54] COMPRESSED CORE-WOUND PAPER PRODUCT HAVING A CORE OPENING AND A PROCESS OF MAKING THE SAME

[75] Inventors: Stephen Kreg Newby, West Chester; Randy Gene Ogg, Cincinnati, both of Ohio

[73] Assignee: The Procter & Gamble Company, Cincinnati, Ohio

[21] Appl. No.: 08/212,379

[22] Filed: Mar. 14, 1994

Related U.S. Application Data

[63] Continuation of application No. 08/135,751, Oct. 12, 1993, abandoned, which is a continuation of application No. 07/758,926, Sep. 11, 1991, abandoned.

[51] Int. Cl.[6] ..... B65B 13/20

[52] U.S. Cl. ..... 53/438; 53/399; 53/409; 53/430

[58] Field of Search ..... 206/389, 397, 206/410; 53/399, 409, 430, 438; 242/159

[56] References Cited

U.S. PATENT DOCUMENTS

| | | | |
|---|---|---|---|
| 334,864 | 1/1886 | Hicks . | |
| 401,233 | 4/1889 | Wheeler . | |
| 1,005,787 | 10/1911 | Sibley . | |
| 1,104,284 | 7/1914 | Wood . | |
| 1,170,590 | 2/1916 | Wheeler | 206/389 |
| 1,316,041 | 9/1919 | Johnson . | |
| 3,537,226 | 11/1970 | Le Van et al. | 53/449 X |
| 3,806,724 | 4/1974 | Powell . | |
| 4,602,472 | 7/1986 | Ampolini et al. | 53/438 |
| 4,762,061 | 8/1988 | Watanabe et al. . | |
| 4,909,388 | 3/1990 | Watanabe . | |
| 5,027,582 | 7/1991 | Dearwester . | |
| B1 4,886,167 | 6/1991 | Dearwester . | |

FOREIGN PATENT DOCUMENTS

| | | | |
|---|---|---|---|
| 1096821 | 3/1981 | Canada . | |
| 625226 | 8/1927 | France | 242/159 |
| 709363 | 5/1954 | United Kingdom . | |

OTHER PUBLICATIONS

Tissue Topics, May 1944 Edition, vol. 1, No. 3 Article entitled "Hoberg Company is Aiding War Effort".

Two letters from N. Barlament describing the Hoberg toilet tissue.

Duluth Lighthouse Toilet Tissue—Toilet tissue sold by the case.

Wall Street Journal Newspaper, Nov. 19, 1991, p. A9.

*Primary Examiner*—Bryon P. Gehman

*Attorney, Agent, or Firm*—Jacobus C. Rasser; E. Kelly Linman; Larry L. Huston

[57] ABSTRACT

Disclosed is a compressed core-wound paper product such as toilet tissue or paper towels. The core-wound paper product comprises a paper product wound about a generally tubular core. The core-wound paper product is compressed, so that the core is flattened to form vertices. By selecting the proper combination of core materials and thickness, to form a core of the proper stiffness; paper product caliper and quantity, to provide hoop forces against the core which are not too great; and total packaging dimensions, so that the core-wound paper product is not too tightly constrained, the core-wound paper product may be made to open to an inside core dimension of about 0.16 centimeters (0.06 inches) to about 1.27 centimeters (0.5 inches). The invention may be utilized with either single roll or multiple roll packages.

6 Claims, 2 Drawing Sheets

COMPRESSED CORE-WOUND PAPER PRODUCT HAVING A CORE OPENING AND A PROCESS OF MAKING THE SAME

This is a continuation of application Ser. No. 08/135,751, filed on Oct. 12, 1993, now abandoned, which is a continuation of application Ser. No. 07/758,926, filed Sep. 11, 1991, now abandoned.

FIELD OF THE INVENTION

This invention relates to core-wound paper products, particularly to compressed core-wound paper products and the cores used in compressed core-wound paper products, and more particularly to compressed core-wound paper products having cores with an opening and the cores therefor.

BACKGROUND OF THE INVENTION

Core-wound paper products are in constant use in daily life. Particularly, toilet tissue and paper towels have become a staple in home and industry. Such products comprises a roll of the consumer goods wrapped in a spiral around a hollow center core. The hollow center core has a a volume which is not used until the product is inserted onto a spindle for dispensing by the consumer.

One factor affecting the pricing and usage of core-wound paper products is the costs of transportation, storage and shelving for such products. These costs reflect the size of the core-wound paper product and are increased by the volume of the core. One attempt in the art to reduce the costs associated with the contribution of the package volume to the size of the core-wound paper product is to compress the product, reducing or eliminating the void space of the hollow core.

For example, as early as 1889, U.S. Pat. No. 401,233 issued Apr. 9, 1889 to Wheeler disclosed a flattened roll of toilet paper having a comparatively rigid interior reinforcement. This arrangement is to allow the incisions, which facilitate insertion of a suspensory device, to lie in the same plane. As early as 1911, U.S. No. Pat. 1,005,787 issued Oct. 10, 1911 to Sibley disclosed a corrugated core for packages of wound fabric. The package is compressed into a flattened state to occupy less space during transportation and stocking. U.S. Pat. No. 1,316,041 issued Sep. 16, 1919 to Johnson disclosed a straight flattened roll of toilet tissue having a core of flexible material with overlapped ends. The flat state was used for shipping, then the roll was bent into a kidney shape for application onto a dispensing fixture.

Compressed core-wound paper product was also used in World War II, per government specifications. As described in the May, 1944 edition of Tissue Topics, the Hoberg Paper Mills Company intra-company newsletter, government toilet tissue was collapsed or flattened and packed in 1,000 sheet rolls with 60 rolls per case. This arrangement was said to have conserved enough space to account for nine months of movement of a Liberty class cargo ship.

One problem associated with compressed core-wound paper products is that of rerounding the cores to a generally cylindrical shape having a circular cross section. Rerounding is necessary to allow a spindle to be inserted through the core, so it can be used on an ordinary dispenser. Rerounding is often effected, as disclosed in U.S. Pat. No. 4,909,388 issued Mar. 20, 1990 to Watanabe, by applying lateral compressive forces to the sides of the compressed core-wound paper product.

When lateral compressive forces are applied to the product, the opposed sides of the core are expected to pop outwardly and away from each other. Each half of the core is then oriented concave towards the center of the core and the other half. However, frequently both halves of the core will buckle in the same direction, forming a somewhat crescent-shaped cross section. This phenomenon is known as core inversion and occurs when both sides of the core buckle such that the two halves of the core are concave in the same direction.

When core inversion occurs upon rerounding, it is very difficult for the consumer to insert the spindle through the opening in the center of the core. The opening is too small to freely admit the spindle and the opposed halves of the core do not readily expand outwardly to be concave in opposite directions once inversion has occurred.

However, the prior art related to compressed core-wound paper products has done little, if anything, to address this phenomenon. For example, commonly assigned U.S. Pat. No. 5,027,582 teaches away from the present invention by disclosing a method of packaging a compressed core-wound paper product by flattening the rolls, securing the flattened rolls to preclude substantial expansion, then relieving the loading used to flatten the rolls.

Other art teaches away as well. For example U. K. Patent Application 709,363 published May 19, 1954 in the name of Samson teaches diametrically flattening the cores and product. U.S. Pat. No. 4,909,388 issued Mar. 20, 1990 to Watanabe teaches flattening the roll product to one-half its original volume or less and maintaining the roll in a particular flattened shape. This patent further teaches that rerounding occurs due to crepes and embosses in the paper product.

One attempt in the art to promote rerounding is found in U.S. Pat. No. 4,762,061 issued Aug. 9, 1988 to Watanabe et al. This patent teaches flattening the paper product through multi-stroke bilateral compression will improve the capability of the core-wound paper product to properly reround.

However, it has been found that rerounding is greatly improved and occurrences of core inversion are obviated if the core is not presented to the consumer in a flattened state—as taught by the aforementioned art. Instead the compressed core-wound paper product should be presented to the consumer with the opposed sides of the core slightly opened and spaced apart from each other as specified below. The size of the opening should not be too small, otherwise the congenital inversion failures noted in the aforementioned prior art will still appear. Conversely, the size of the opening should not be too great, otherwise, in addition to defeating the desired economies of space savings, the core-wound paper product will appear to be product which has been inadvertently damaged, rather than deliberately compressed to a slight degree. Such appearance may evoke a negative consumer reaction without providing an offsetting benefit of economization.

Cores for core-wound paper products having an opening are taught in the aforementioned U.S. Pat. No. 1,005,787 issued Oct. 10, 1911 to Sibley. This patent discloses a corrugated core which is somewhat elastic, yet either flexible or yielding. However, this patent does not teach the relationship between the corrugated core and the material wound thereon necessary to achieve a core opening which minimizes core inversions. Instead this patent simply teaches that the relationship between the core and the material wound thereon should permit the core to be inserted into the packages after the rolls are expanded, so that no difficulty is experienced in changing the roll shape. Clearly the step of inserting the core after expanding the product is an added inconvenience most consumers would find unacceptable.

It is an object of this invention to improve the ability of the consumer to reround, with fewer occurrences of core inversion, the core of a compressed core-wound paper product to a generally cylindrical shape having a circular cross section. It is an object of this invention to produce a compressed core-wound paper product which encounters reduced occurrences of core inversion when the consumer attempts to reround the core to a generally cylindrical shape having a circular cross section.

BRIEF SUMMARY OF THE INVENTION

This invention relates to core-wound paper products which have been compressed to reduce the volume of the core void space. The compressed core-wound paper product has a generally tubular core with a cross section having diametrically opposed vertices. The vertices define the major axis of the core. A minor axis having dimensions of about 0.16 centimeters to about 1.27 (0.06 to 0.50 inches) and preferably about 0.51 centimeters to about 0.89 centimeters (0.20 to 0.35 inches) is orthogonal the major axis. Both the major and minor axes lie within the cross section of the core.

A cellulosic paper product is wound about the core in a spiral pattern. The compressed core-wound paper product also has a constraining means for maintaining the compressed core-wound paper product in a compressed state.

The compressed core-wound paper product further has a means for opening the core to the aforementioned dimensions of the minor axis after the core has been flattened until opposing halves of the core are in contact with one another.

BRIEF DESCRIPTION OF THE DRAWINGS

While the Specification concludes with claims particularly pointing out and distinctly claiming the present invention, it is believed the same will be better understood from the following description taken in conjunction with the accompanying drawings in which like parts are given the same reference numeral and:

DETAILED DESCRIPTION OF THE INVENTION

Figure 1:
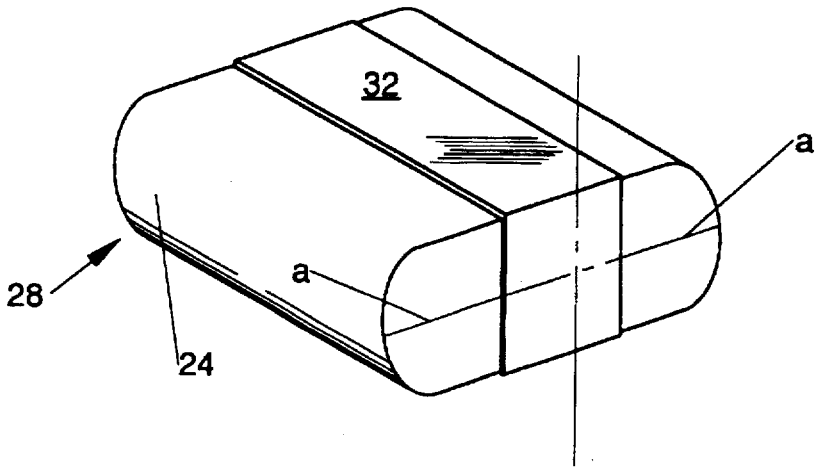
FIG. 1 is a perspective view of a core-wound paper product according to the present invention.

As illustrated in FIG. 1 and as used herein, a "core" refers to a hollow tubular member about which another component is wound in a spiral pattern for later dispensing and removal. As used herein, a "paper product" refers to a cellulosic base product wound onto the core 20 and is removed, typically, in batch form, i.e., one or more sheets at a time, for usage and eventual discard. Used paper product 24, when taken from the core 20, is not returned.

As used herein a "core-wound paper product" refers to the aggregation of a "core" and a "paper product" wound thereon. A "compressed core-wound paper product" refers to a "core-wound paper product" which is diametrically loaded and deformed from a round cross section. A compressed core-wound paper product 28 which has been "flattened" has been compressed until the core 20 is no longer generally hollow, and has portions of the two major faces in contact with one another at any point along the longitudinal axis.

As is well understood by one skilled in the art, the core-wound paper product 28 may further comprise a wrapping, banding or other packaging 32 to maintain the compressed configuration illustrated by FIG. 1. This wrapping, banding or other packaging 32 serves as a constraining means to maintain the core-wound paper product 28 in the compressed configuration and the desired cross section.

A core 20, according to the present invention, may advantageously be used for paper products 24 such as toilet tissue or paper towels. The core 20 is generally cylindrical prior to compression and flattening, has an axial length defined by two oppositely disposed ends. The ends of the core 20 are circular in cross section prior to flattening. The line connecting the centers of these circles is the "longitudinal axis" of the core 20. As used herein "axial" refers to the direction of the longitudinal axis.

When toilet tissue is wound on the core 20, the resulting core-wound paper product 28 of toilet tissue typically has a diameter of about 10.2 centimeters to about 12.7 centimeters (4.00 to 5.00 inches) and a length of about 11.4 centimeters (4.50 inches) between the ends. If a core 20 embodying the present invention is used for paper towels, the core-wound paper product 28 of paper towels typically has a diameter of about 10.2 to about 15.2 centimeters (4.00 to 6.00 inches) and a length of about 27.9 centimeters (11.0 inches) for the embodiments described herein.

It is preferred, but not necessary that the core 20 and the paper product 24 used for the present invention have the same axial lengths. If there is a discrepancy between the axial lengths, generally, but not necessarily the core 20 or the paper product 24 having the greater axial length will control the performance of the other.

The core 20 may be made of two layers of a paper having any suitable combination of cellulosic fibers such as bleached krafts, sulfites, hardwoods, softwoods, and recycled fibers. The core 20 should exhibit uniform strength without weak spots. Preferably, the core 20 is not calendared, so that it is relatively stiff and retains adhesive deposited thereon. The core 20 should have a mullen strength of at least 60 and preferably at least 70 as measured according to ASTM Test Method D2529. The core 20 may have a thickness of at least about b0.05 centimeters (0.020 inches) and preferably has a thickness of at least about 0.07 centimeters (0.028 inches). The core 20 should be free of objectionable odors, impurities or contaminates which may cause irritation to the skin.

The core 20 may be made of paper having a basis weight of about 0.19 to about 0.21 kilograms per square meter (38 to 42 pounds per 1,000 square feet), although cores 20 having a basis weight as high as 0.23 kilograms per square meter (47 pounds per 1,000 square feet) have been found to work well in the present invention. For the embodiments described herein, the core 20 should have a cross machine direction ring crush strength of at least about 74.4 kilograms per meter (50 pounds per inch) and preferably at least about 89.3 kilograms per meter (60 pounds per inch) as measured according to Tappi Standard T818 OM-87.

Figure 2:
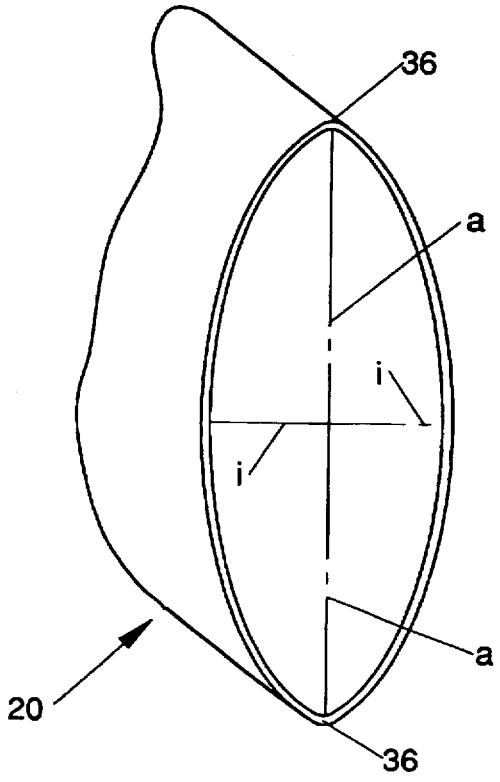
FIG. 2 is an fragmentary perspective view of a core according to the present invention showing the two oppositely disposed vertices.

As illustrated in FIG. 2, when compressed, the core 20 is subjected to diametrically applied compressive forces. As used herein, "diametrically applied compressive forces" refer to opposed compressive forces applied at any diameter of any cross section of the core 20. The diametrically applied compressive forces may occur at any point along, or throughout the entire axis of, the core 20. It is, of course, to be recognized that compressive forces may be applied along a chord of the cross section and not be coincident a diameter.

Typically, the diametrically applied compressive forces are not directly applied to the core 20. Usually, the diametrically applied compressive forces are applied to the paper product 24 and radially transmitted therethrough to the core 20. However, the principles involved in applications through the paper product 24 or along a chord of a diameter are substantially similar to those of diametrically applied compressive forces applied directly to the core 20 and, will not be further distinguished or otherwise repeated.

Upon application of the diametrically applied compressive forces, the core 20 will collapse into the flattened condition of FIG. 2. The cross section of the flattened core 20 of FIG. 1 has a major axis a—a, and a mutually orthogonal minor axis i—i. The major axis a—a and minor axis i—i of the cross section are transverse, orthogonal the longitudinal axis of the core 20 and lie within the cross section of the core 20. The major axis a—a is aligned with the longest dimension of the cross section of the paper product 24 when flattened, and the minor axis i—i is the perpendicular bisector thereto. The resulting flattened core 20 has two vertices 36, one located at each end of the major axis a—a.

It will be recognized by one skilled in the art that the major and minor axes a—a and i—i will be unequal in length, unless the cross section of the core 20 is circular (or square). Due to variations in the manufacturing process, the cross section of the core 20 is usually not constant throughout the axial length of the core 20, particularly when the core 20 is compressed. However, the major and minor axes a—a and i—i of concern in the present invention are those at either end of the core-wound paper product 28, for that is where the consumer inserts the spindle into the core 20.

It is necessary to apply the diametrically opposed laterally compressive forces to the core-wound paper product 28 until the opposing halves of the core 20 are in contact with one another, so that the vertices 36 are formed. The vertices 36 define the ends of the major axis a—a. The vertices 36 are coincident the inner surface of the core 20. The termini of the minor axis i—i are likewise coincident the inner surface of the core 20.

Figure 3:
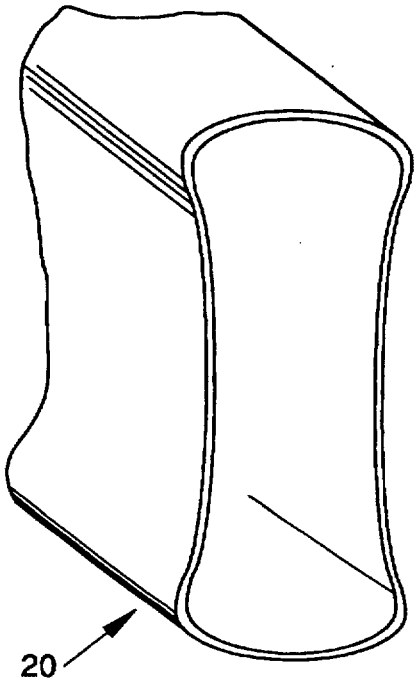
FIG. 3 is an fragmentary perspective view of a core having a generally dog-boned shaped cross section.
Figure 4:
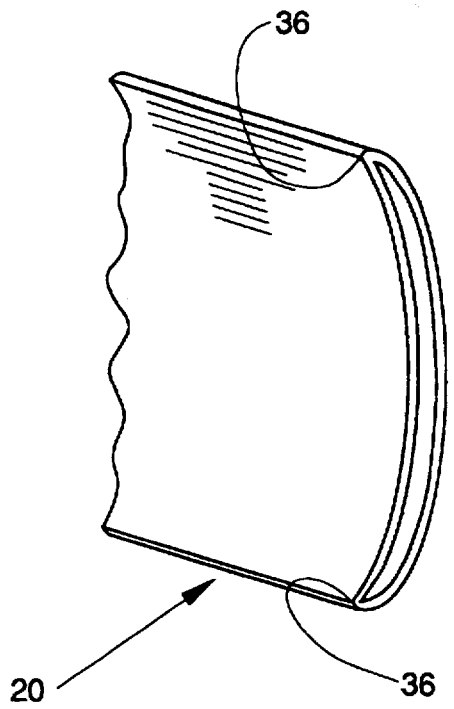
FIG. 4 is an fragmentary perspective view of a core which has inverted upon rerounding.

If the diametrically opposed laterally compressive forces are not sufficient to form vertices 36 in the core 20, it will have a somewhat dog-bone shaped cross section, as illustrated in FIG. 3. A compressed core 20 having a dog-bone shaped cross section is highly undesirable, because such a core 20 is generally more prone to inversion upon rerounding, as illustrated in FIG. 4.

Referring again to FIG. 1, after compressing the core-wound paper product 28 until the opposed halves of the core 20 contact and the vertices 36 are formed, the diametrically opposed laterally compressive forces are relieved somewhat, to allow the core 20 to partially reopen, without returning to a round cross section. The core-wound paper product 28 is then packaged for shipment and sale.

For the embodiments described herein, core-wound paper products 28 which have an opening across the minor axis i—i of about 0.16 centimeters to about 1.27 centimeters (0.06 to 0.50 inches), and preferably about 0.51 centimeters to about 0.89 centimeters (0.20 to 0.35 inches) have been found to work well. The compression relieving cycle may be generally conducted in accordance with the teachings of U.S. Pat. No. 5,027,582 issued Jul. 2, 1991 to Dearwester, which patent is incorporated herein by reference for the purpose of showing one method of packaging a core-wound paper product 28 according to the present invention.

The dimension of the minor axis i—i may be easily measured by several known means. However, the preferred means is to a ordinary scale, such as made by the Starrett Instrument Company, and having a resolution with graduations approximately one-sixteenth inch (0.16 centimeters) apart. The scale is placed against the end of the core 20, in the plane of the cross section and visually aligned parallel the minor axis i—i. The dimension of the minor axis i—i is then read from the scale as the linear distance between the inside surfaces of the core 20 on opposite sides of the longitudinal axis.

It is to be recognized that a suitable compressed core-wound paper product 28 may be constructed without having the specified minor axis i—i dimension. Instead, such compressed core-wound paper product 28 may have a lesser dimension of the minor axis i—i (or even be flattened at the minor axis i—i) providing an opening of the aforementioned dimension is provided near one of the vertices 36. However, such an embodiment is not preferred, because it is difficult to achieve the proper spring action of a core 20 having such a configuration.

The paper product 24 compressed and utilized with the core 20 may be a toilet tissue having a basis weight of about 0.183 to about 0.324 grams per square meter (0.004 to 0.008 pounds per square foot). Such a paper product 24 may be made of one laminae or of two superimposed laminae having an aggregate basis weight within the aforementioned limits. The paper product 24 may be made of a mixture comprising cellulosic fibers.

As used herein, a core 20 or a paper product 24 is considered cellulosic if it comprises at least about 50 weight percent or at least about 50 volume percent cellulosic fibers. Cellulosic fibers include, but are not limited to cotton linters, rayon, bagasse, wood pulp, such as softwoods (gymnosperms and coniferous) or hardwoods (angiosperms and deciduous) and aggregations of the foregoing. Noncellulosic fibers which may be incorporated into a cellulosic core 20 or a cellulosic paper product 24 include without limitation synthetic fibers such as polyolefins, polyesters and nylons. A cellulosic mixture comprising about 30 percent softwood fibers and about 70 percent hardwood fibers has been found to work well for the core-wound paper product 28 described and claimed herein.

The paper product 24 may be made with layered cellulosic fibers on a blow through drying papermaking machine. Particularly, a paper product 24 made in accordance with the teachings of commonly assigned U.S. Pat. No. 3,994,771 issued Nov. 30, 1976 to Morgan Jr. et al.; commonly assigned U.S. Pat. No. 4,529,480 issued Jul. 16, 1985 to Trokhan; and commonly assigned U.S. Pat. No. 4,637,859 issued Jan. 20, 1987 to Trokhan, all of which patents are incorporated herein by reference for the purpose of showing how to make a paper product 24 suitable for use with the claimed invention, has been found to work well with the present invention.

The construction of the core-wound paper product 28 provides a means for opening the core 20 to the dimensions across the minor axis i—i specified above after the core 20 has been flattened until the opposing halves of the core 20 contact with one another. Such a means for opening the core 20 is easy to understand if the core 20 and the paper product 24 are considered to be two springs arranged in series along the direction the diametrically applied compressive forces are applied, which direction is generally parallel the minor axis i—i.

As is well known to one skilled in the art the force (f) exerted by a spring is the product of its spring rate (k) multiplied by any deflection (x). In a core-wound paper product 28 according to the present invention, the core 20 acts as a compression spring, resisting the diametrically applied compressive forces by expanding outwardly until any restraining force constrains the core 20 from further expansion. Conversely, the paper product 24 exerts a radial force against the core 20 which must be overcome for the core to expand to the minor axis dimensions specified above.

Note that it is necessary for the core-wound paper product 28 to maintain the specified dimension after the core 20 has been compressed until opposing halves are in contact with one another. It is not recommended to compress the core 20 directly to the specified dimensions, without passing through the specified dimension—as the core 20 is preferably flattened until contact occurs. If the core-wound paper product 28 is made in this manner, as noted above the undesired dog bone shaped cross section of FIG. 3 will likely result.

Any combination of spring rates, spring forces, and deflections which produces a minor axis dimension of about 0.16 centimeters to about 1.27 centimeters (0.06 to 0.50 inches), and preferably about 0.51 centimeters to about 0.89 centimeters (0.200 to 0.350 inches) is suitable. It is only necessary that the core 20 be able to overcome the restraining forces and expand to this dimension after flattening until contact has occurred. Of course, it will be apparent to one skilled in the art that the final package dimensions will be a critical parameter which determines selection of the other variables.

In a particularly preferred embodiment according to the present invention, the means for opening the core 20 to the desired dimension comprises a spring integral with the core 20. As used herein, a spring is considered "integral" with the core 20 if the core 20 does not require the addition of a separate or independent element to incorporate the spring. In a particularly preferred embodiment, the spring results from the stiffness of materials used to construct the core 20.

While it is generally contrary to the conventional wisdom of providing relatively thinner gauge core 20 materials for purposes of economy and land-fill minimization, it has been found, as noted above, generally heavier gauge core 20 materials work well with the present invention to provide the requisite stiffness. Further, the core 20 can be stiffened to incorporate the aforementioned integral spring by proper selection of adhesive and fibers in its construction.

Alternatively, rather than stiffen the core 20 to provide a means for opening the core 20 to the specified minor dimensions, the paper product 24 may be constructed to provide less resistance to the opening of the core 20. For example, hoop stresses associated with winding the paper product 24 onto the core 20 will restrain the core 20 from expanding. Therefore, a more loosely wound paper product 24 will work well with a core 20 of relatively lesser stiffness.

Alternatively, the outside dimension, taken parallel the minor axis i—i, of the constraining means may be adjusted to suit the selected combination of core 20 and paper product 24. For example, for a given amount of paper product 24 wound about the core 20 at a particular tension, a particular radial dimension (the distance from the outside of the core 20 to the outside of the paper product 24) will result. This radial dimension may be adjusted for the final dimension of the constraining means taken parallel the minor axis i—i by increasing or decreasing the caliper of the paper product 24.

Caliper changes naturally occur over time in paper products 24. Therefore, it may be desirable to calendar the paper product, so that time dependent caliper changes are minimized.

If it is not desired to adjust the caliper of the paper product 24, so a particular radial dimension can be achieved, the final dimension of the constraining means may be adjusted instead. It will be apparent to one skilled in the art that either a reduction in the radial dimension of the paper product 24 or an increase in the final dimension of the constraining means may be used with a relatively less stiff core 20, than in a core-wound paper product 28 where these parameters were not so adjusted.

While the foregoing discussion has been directed to individually packaged compressed core-wound paper products 28, as illustrated in commonly assigned U.S. Pat. No. B1 4,886,167 issued Jun. 11, 1991 to Dearwester and commonly assigned U.S. Pat. No. 5,027,582 issued Jul. 2, 1991 to Dearwester, it is often desirable to utilize compressed roll paper products 28 in multiple roll packages. Particularly, an array of four compressed core-wound paper products 28 arranged in a single row with parallel longitudinal axes has been found advantageous, although the present invention includes single roll configurations, and configurations having a plurality of rolls less than, equal to and more than four rolls.

By way of example, an illustrative package containing four identical core-wound paper products 28 according to the present invention is described. Both the cores 20 and the paper products 24 had an axial length of about 11.43 centimeters (4.5 inches). Prior to compression and flattening, the core-wound paper product 28 had an outside diameter of about 10.4 centimeters (4.1 inches) and a radial dimension of about 3.1 centimeters (1.24 inches).

The cores were made of 0.21 kilogram per square meter (42 pound per 1,000 square foot) mottled white tubestock supplied by the Menominee Paper Company of Menominee, Mich. The tubestock had a width of about 7.3 centimeters (2.88 inches) and a caliper of about 0.36 centimeters (0.14 inches).

The cores 20 were spiral wound edge to edge at an angle of about 34 degrees from the longitudinal axis and adhered throughout with a 0.03 millimeter (0.001 inch) thick layer of 48 percent solids dextrin adhesive supplied by The National Starch and Chemical Company of Bridgewater, N.J. The cores 20 had an inside diameter of about 4.13 centimeters (1.63 inches) and a thickness of about 0.07 millimeters (0.028 inches).

The paper product 24 utilized in this example was Charmin brand toilet tissue manufactured by The Procter & Gamble Company of Cincinnati, Ohio. The paper product 24 had a basis weight of about 0.253 grams per square centimeter (0.006 pounds per square foot) and a caliper of about 0.27 millimeters (0.011 inches). Each of the four core-wound paper products 28 had 280 perforated sheets of the paper product 24. Each sheet of the paper product 24 was 11.2 centimeters (4.4 inches) long, and, as noted above 11.4 centimeters (4.5 inches) in width—corresponding to the axial length of the paper product 24.

Each core-wound paper product 28 was individually compressed to a dimension of about 5.1 centimeters (2.0 inches) to ensure flattening occurred and the vertices 36 were completely formed. The four core-wound paper products 28 were placed in the package as described above. The package of four core-wound paper products 28 was then compressed to a total width, aggregating all four minor axes i—i, of about 21.8 centimeters (8.56 inches).

While compressed to this dimension, the package of four core-wound paper products 28 was wrapped in a single sheet of medium density polyethylene film having a thickness of about 0.04 millimeters (0.0015 inches) supplied by the Exxon Chemicals Company of Houston, Tex. as model number EW-20S. There was minimal, if any, preload or winding tension applied to the package of four core-wound paper products 28 while it was wrapped with the film.

Within one minute, the means for opening the cores 20 to the specified minor dimensions sua sponte expanded the package to a total width of about 25 centimeters (10 inches). It was noted that not each core 20 opened to the same dimension. The two outboard cores 20 opened slightly more than the two central cores 20. However, each core 20 acceptably opened to a value within the preferred range set forth above.

Four of the aforementioned packages, each containing four core-wound paper products 28 as described above, were tested according to the following procedure to determine the reaction to diametrically applied compressive forces and the spring rates (k) of the packages. The results are given below in Table I and graphically illustrated in FIG. 5.

An Instron Model 4500 tensile machine made by the Instron Corporation of Canton, Mass. was utilized. The package of core-wound paper product 28 under consideration was loaded into the tensile machine with the longitudinal axis and the major axis a—a perpendicular the direction of travel of the crosshead. Each compressed core-wound paper product 28 was arranged with the minor axes i—i colinear and parallel the direction of travel of the crosshead.

The core-wound paper product 28 was compressed at a rate of about 5.1 centimeters per minute (2.0 inches per minute) until the opposed halves of the core 20 were visually observed to be in contact. The reactive force of the core-wound paper product 28 against the crosshead was measured at intervals of 0.64 centimeters (0.25 inches), corresponding to the deflection of the core-wound paper product 28 in response to such applied force.

The results given in Table I show the deflection in inches in the first column, and the reactive force in pounds of each package at the particular deflection in the second through fifth columns. The sixth column gives the average force reading for the preceding four columns.

TABLE I

| | Reactive Force | | | | |
|---|---|---|---|---|---|
| Deflection | Pkg 1 | Pkg 2 | Pkg 3 | Pkg 4 | Avg. Pkgs 1–4 |
| 0.00 | 0.0 | 0.0 | 0.0 | 0.0 | 0.0 |
| 0.25 | 2.5 | 2.7 | 2.5 | 2.7 | 2.6 |
| 0.50 | 4.0 | 4.4 | 4.2 | 4.4 | 4.3 |
| 0.75 | 5.8 | 6.2 | 5.9 | 6.3 | 6.1 |
| 1.00 | 7.8 | 8.1 | 7.8 | 8.1 | 8.0 |
| 1.25 | 10.0 | 10.1 | 9.8 | 10.2 | 10.0 |
| 1.50 | 12.6 | 12.4 | 12.2 | 12.5 | 12.4 |
| 1.75 | 15.9 | 15.0 | 14.7 | 15.1 | 15.2 |
| 2.00 | 19.7 | 17.9 | 17.8 | 18.0 | 18.4 |
| 2.25 | 24.2 | 21.5 | 21.5 | 21.4 | 22.2 |

Figure 5:
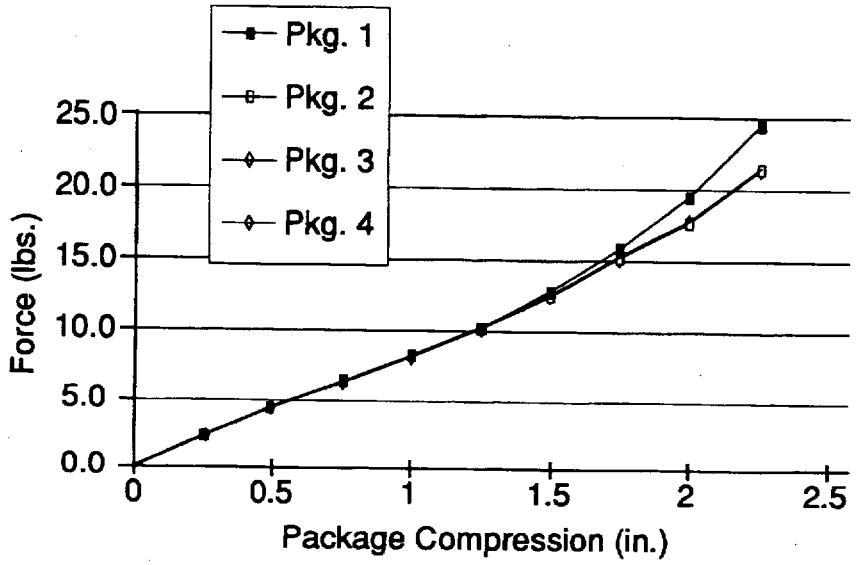
FIG. 5 is a graphical representation of the spring rate for a package of four compressed core-wound paper products according to the present invention.

These forces and deflections were plotted to yield the spring rate curve for the package in parametric units of pounds per inch. Referring to FIG. 5, it is noted that the response of each package is relatively linear throughout approximately the first 1.5 inches of deflection. The packages of four core-wound paper product 28 according to the present invention exhibited a spring rate (k) of about 9.3 pounds per inch. Of course, since the package may be analyzed as four springs in series, with each core-wound paper product 28, comprising one spring, it would be expected that each core-wound paper product 28 would have a spring rate (k) approximately four times as great as that of the total package.

What is claimed is:

1. A method of making a compressed core-wound paper product, said method comprising the steps of:

providing a generally tubular core having a circular cross section;

providing a cellulosic paper product;

winding said paper product about said tubular core in a spiral pattern;

flattening said core until two diametrically opposed vertices defining a major axis and a minor axis orthogonal thereto are formed and opposing halves of said core are in contact, said major and minor axes lying within said cross section of said core;

providing a constraining means for maintaining said core-wound paper product in a compressed state;

packaging said core-wound paper product in said constraining means while said core-wound paper product is in a compressed state;

providing a means in said compressed core-wound paper product for opening said core to a dimension of said minor axis of about 0.16 centimeters to about 1.27 centimeters, after said core has been flattened until opposing halves of said core are in contact with one another; and opening said core to said dimension of said minor axis while said core-wound paper product is packaged in said constraining means.

2. A method of making a compressed core-wound paper product according to claim 1 wherein said core is opened to a minor dimension of about 0.51 centimeters to about 0.89 centimeters.

3. A method of making a compressed core-wound paper product, said method comprising the steps of:

providing a generally tubular core having a circular cross section and a cellulosic paper product, said cellulosic paper product being wound around said tubular core in a spiral, said tubular core and said spiral wound paper product being diametrically flattenable, said core and said cellulosic paper product each having a spring constant, whereby said core-wound paper product is adapted to reopen after flattening;

diametrically flattening said core-wound paper product with diametrically opposed forces until the opposing halves of said core are in contact with one another and said flattened core defines a major axis and a minor axis orthogonal thereto, said major and said minor axes lying within the cross section of said core;

releasing said diametrically opposed restraining forces until said core opens to a minor axis dimension of about 0.16 centimeters to about 1.27 centimeters, whereby said core is less prone to inversion during rerounding than a flattened core;

providing a constraining means; and packaging said core-wound paper product in said constraining means so that said minor axis dimension of about 0.16 centimeters to about 1.27 centimeters is maintained while said core-wound paper product is packaged.

4. A method of making a core-wound paper product according to claim 3 wherein said core reopens to a minor axis dimension of about 0.51 centimeters to about 0.89 centimeters.

5. A method of making a core-wound paper product according to claim 3 wherein said constraining means is wrapped around said core-wound paper product before said diametrically opposed forces are released and said core opens to said minor axis dimension.

6. A method of making a core-wound paper product according to claim 5 wherein said step of providing a generally tubular core and a cellulosic paper product wound therearound in a spiral comprises the step of providing a plurality of juxtaposed core-wound paper products, each of said cores of said core-wound paper product having a longitudinal axis, the longitudinal axes of said cores being mutually parallel.

* * * * *